United States Patent [19]

Deeg

[11] 4,020,996

[45] May 3, 1977

[54] METHOD AND APPARATUS FOR WINDING ELONGATED COILS

[75] Inventor: Wyman L. Deeg, Vernon Hills, Ill.

[73] Assignee: C. P. Clare & Company, Chicago, Ill.

[22] Filed: Dec. 3, 1975

[21] Appl. No.: 637,388

[52] U.S. Cl. ..... 242/7.03; 140/92.1; 242/7.09; 242/7.11; 242/7.13; 242/7.14

[51] Int. Cl.[2] ..... H01F 41/06; B65H 81/06

[58] Field of Search ..... 242/7.03, 7.13, 7.14, 242/7.17, 7.18, 7.19, 7.09, 7.11; 140/92.1

[56] References Cited

UNITED STATES PATENTS

| | | | |
|---|---|---|---|
| 2,862,671 | 12/1958 | Dimond | 242/7.18 |
| 3,101,180 | 8/1963 | Sadorf | 242/7.14 X |
| 3,222,000 | 12/1965 | White | 242/7.14 |
| 3,451,633 | 6/1969 | Markham et al. | 242/7.18 X |
| 3,713,599 | 1/1973 | Smith et al. | 242/7.18 |
| 3,810,587 | 5/1974 | Muskulus | 242/7.03 |

*Primary Examiner*—Billy S. Taylor
*Attorney, Agent, or Firm*—Mason, Kolehmainen, Rathburn & Wyss

[57] ABSTRACT

A coil winding machine for winding arrays of closely-spaced, irregularly shaped coils utilizes a winding head that moves elliptically about the coil being wound. The elliptical motion permits compact arrays to be produced economically by allowing more closely spaced coils to be wound than can be wound with a winding head having circular motion. The machine is programmable automatically to step between coils of the array, and to wind the coils in any desired direction. A turns counter is utilized gradually to slow the head prior to the completion of each winding operation, and a position detector is used to position the head between rows of coils as the head is advanced to the next coil to be wound.

18 Claims, 12 Drawing Figures

10
18
14
132
126
108
110
106
6
94
100
28
96
98
30
84
147
146
140
22
24
20
32
58
50
52
34
48
38
40
46
54
44
56
42
104
114
102
118
122
120
124
128
112
116

METHOD AND APPARATUS FOR WINDING ELONGATED COILS

BACKGROUND OF THE INVENTION

1. Field of the Invention

This invention relates generally to coil winding machines, and more particularly, to automatic coil winding machines utilizing a rotating winding head for winding arrays of coils.

2. Brief Description of the Prior Art

Automatic coil winding machines are known. Such machines generally employ one or more coil winding heads that may be stepped in a predetermined sequence to wind each of the individual coils in an array. Such machines generally employ a winding head that describes a circular orbit around the coil being wound regardless of the shape of the coil. When noncircular coils are wound, automatic tensioning devices are provided to take up the slack in the wire that may occur as various portions of the coil are traversed.

While the prior art machines provide a way automatically to wind an array of coils, the circular winding motion tends to limit the compactness of the array when non-circular coils are wound. This occurs because the diameter of the circle described by the winding head must be large enough to accommodate the longest cross sectional dimension of the coil. As a result, adjacent rows of coils must be spaced far enough apart to permit the winding head to pass between adjacent coils during the winding operation. The last mentioned requirement causes otherwise unnecessarily large spacing between the coils of the array, particularly when coils having a high aspect ratio cross section are used.

SUMMARY OF THE INVENTION

An object of the present invention is to provide an automatic coil winding machine that overcomes many of the disadvantages of the prior art machines.

Another object of the present invention is to provide an improved coil winding machine for winding coils having an irregularly shaped cross section.

Another object of the present invention is to provide a coil winding machine having an elliptically moving winding head.

Another object of the present invention is to provide a coil winding machine for automatically winding an array of closely-spaced, irregularly shaped coils.

In accordance with a preferred embodiment of the invention, a winding head is mechanically coupled to a rotary driving mechanism, such as an electric motor by a flexible shaft. The winding head is rotatably and slidably mounted in a housing to permit the head to be simultaneously rotated and moved laterally in a direction perpendicular to the axis of rotation of the head. Lateral motion is imparted to the winding head by a crank formed in the drive shaft. The crank passes through an elongated aperture formed in a stationary plate, and engages the plate to cause the head to be displaced laterally upon rotation of the drive shaft.

A counter is utilized to count the number of rotations of the head and to stop the head when a predetermined number of rotations have been completed. The counter is also provided with an output that provides a signal for slowing the rotational speed of the head before the head is stopped. A head position sensing circuit is also provided to sense the position of the head and to stop the head in a predetermined position to permit the head to clear each of the coils after it is wound. A rotation reversing circuit is provided so that coils may be automatically wound in either direction.

The other objects and advantages of the present invention will become apparent from the following specification taken in conjunction with the accompanying drawings wherein:

FIG. 8 is a detailed cross sectional view of the motion translator taken along line 8—8 of FIG. 6;

Figure 1:
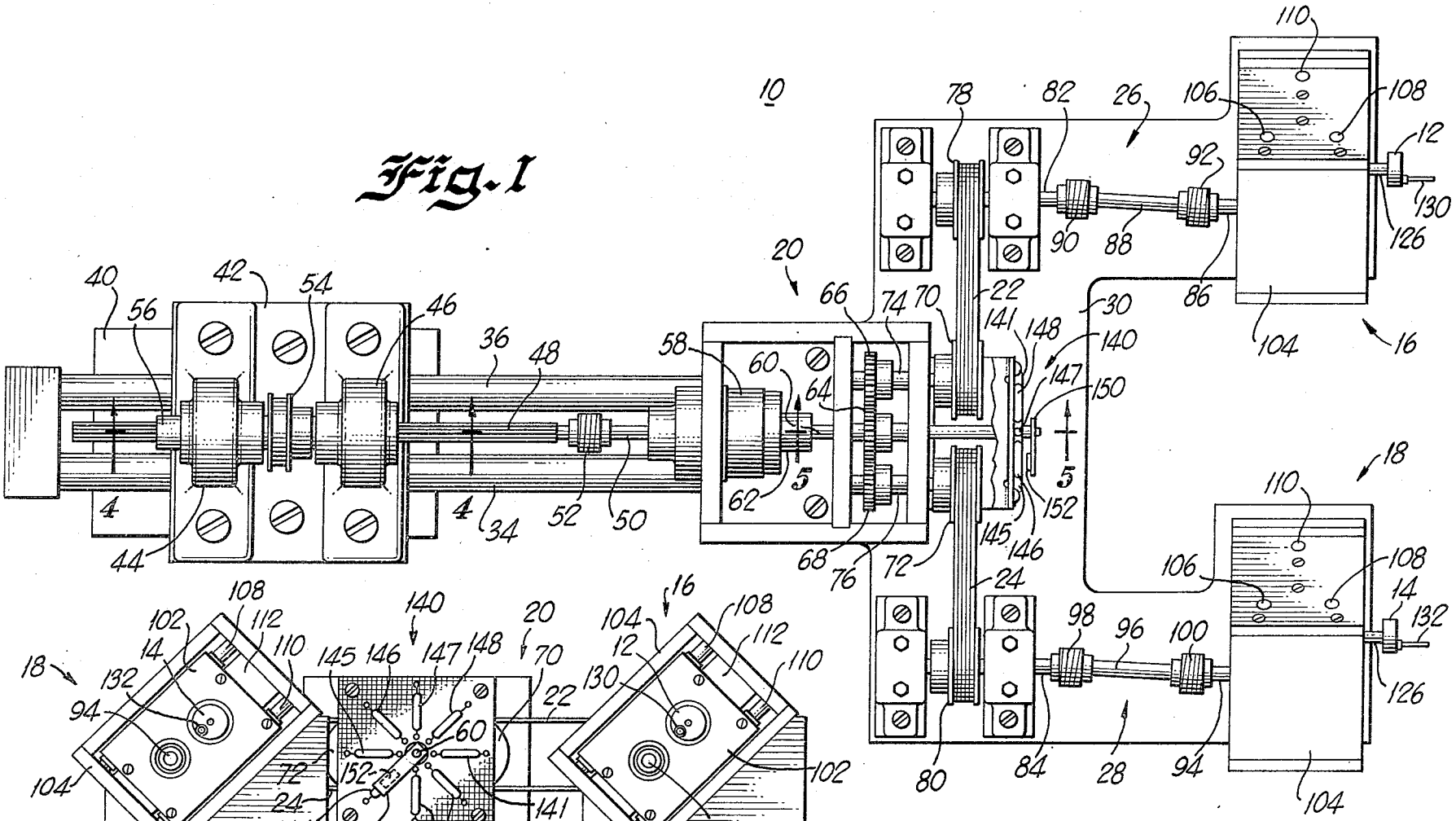
FIG. 1 is a top view of a winding head assembly having elliptically moving winding heads in accordance with the invention.
Figure 2:
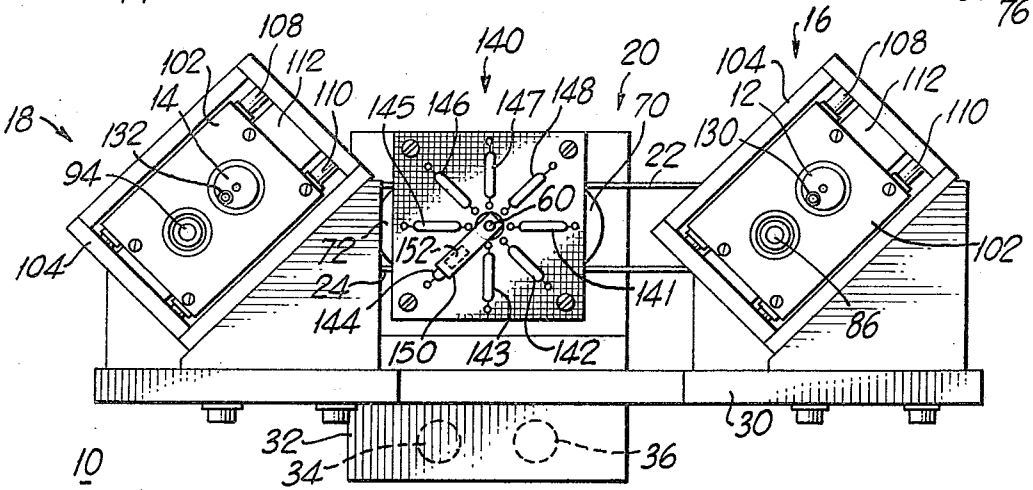
FIG. 2 is a front view of the head assembly according to the invention.
Figures 3, 5, 7:
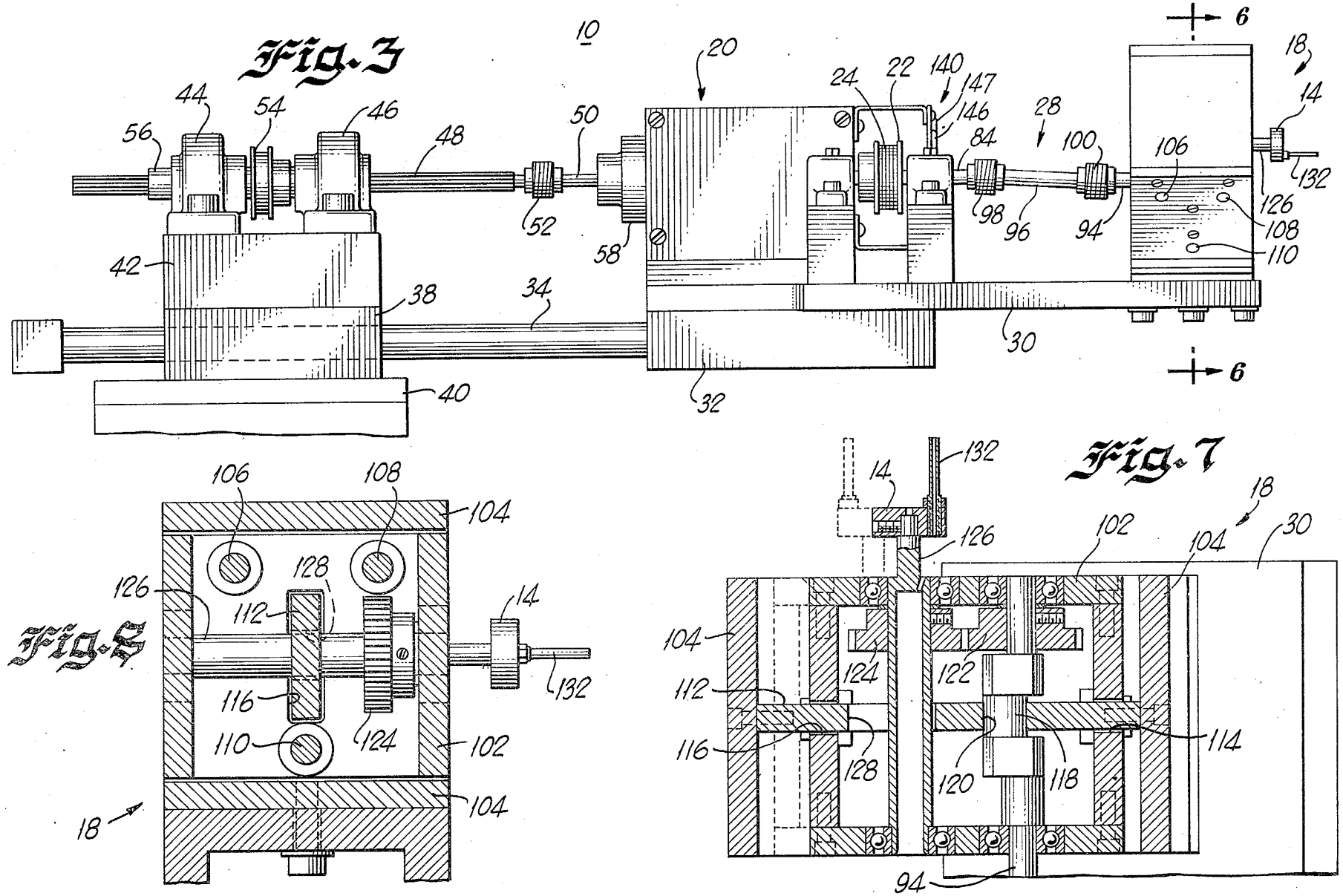
FIG. 3 is a side view of the head assembly according to the invention.
FIG. 5 is a detailed cross sectional view of the drive and head position sensing assemby taken along line 5—5 of FIG. 1.
FIG. 7 is another detailed cross sectional view of the rotary to elliptical motion translator and winding head taken along line 7—7 of FIG. 6.
Figure 4:
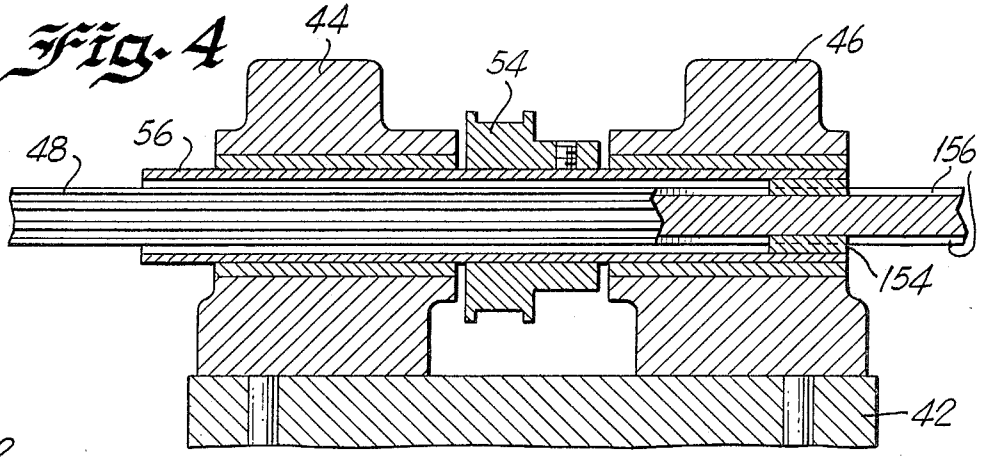
FIG. 4 is a detailed cross sectional view of a sliding bearing used in conjunction with the head assembly according to the invention taken along line 4—4 of FIG. 1.
Figure 5:
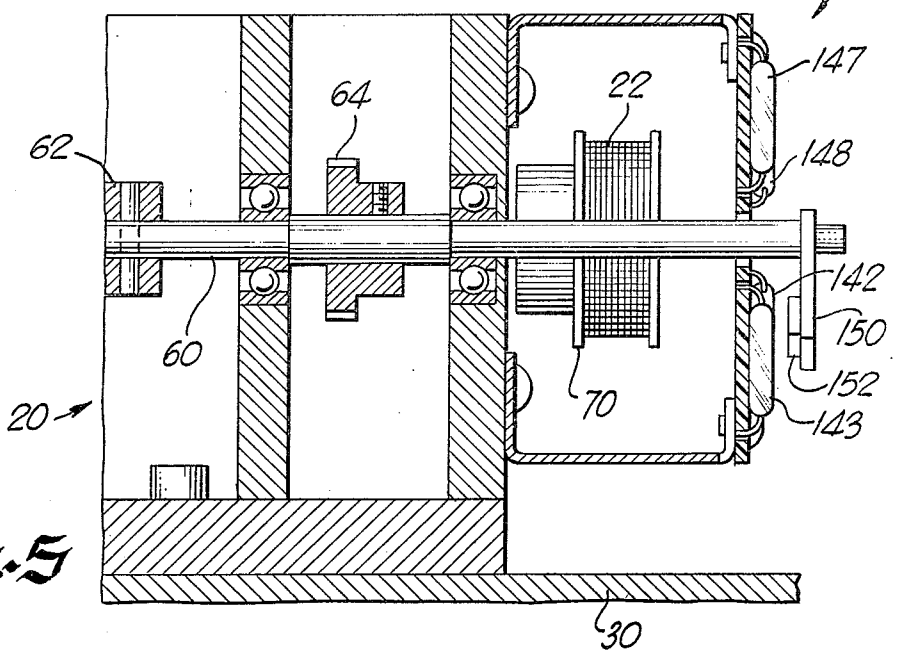

Referring now to the drawings, with particular attention to FIGS. 1–3, there is shown a two head embodiment of the elliptically moving head assembly according to the invention, generally designated by the reference numeral 10. The machine according to the invention is particularly useful for winding arrays of the type described in co-pending United States patent application Ser. No. 637,389, filed Dec. 3, 1975 entitled "Memory Matrix" and filed by the same inventor on the same date as the present application. The above co-pending application is incorporated herein by reference.

The head assembly 10 comprises a pair of elliptically moving winding heads 12 and 14 and a pair of motion translators 16 and 18 for elliptically driving the heads 12 and 14, respectively. The motion translators 16 and 18 are driven from a power splitter 20 by means of a pair of belts 22 and 24 that drive a pair of respective shaft assemblies 26 and 28. In the embodiment shown in the figures, two identical heads 12 and 14 and two identical motion translators are utilized so that two separate coil arrays may be wound simultaneously.

The motion translators 16 and 18 and the power splitter 20 are fixedly mounted to a base plate 30. The base plate 30 is affixed to a second plate 32 that is fixedly attached to a pair of supporting rods 34 and 36 which are slidably mounted through a block that is affixed to a frame 40 of the machine. A second block 42 is attached to the block 38 and supports a pair of sliding shaft bearings 44 and 46. A splined shaft 48 passes slidably through the bearings 44 and 46 and is coupled to an input shaft 50 of the power splitter 20 by a flexible coupling 52. A drive pulley 54 is interposed between the bearings 44 and 46 and drives a sleeve 56. The splined shaft 48 is slidably mounted within the sleeve 56 and is driven by the sleeve 56, and serves to transmit power to the winding heads 12 and 14.

In operation, the pulley 54 is driven by a belt (not shown) that is connected to a rotary power source such as a coil winding machine (also not shown). A suitable winding machine usable as the driving machine is the Meteor Model ME307-01 compact winding machine. The rotary motion applied to the pulley 54 is coupled to the splined shaft 48 through the sleeve 56. Power from the shaft 48 is transmitted through the flexible coupling 52 to the shaft 50 which passes through a bearing 58 and is coupled to a shaft 60 by a sleeve 62. The shaft 60 drives a central gear 64 that drives a pair of laterally displaced gears 66 and 68. The gears 66 and 68 drive a pair of pulleys 70 and 72 that are coupled to the gears 66 and 68 by a pair of shafts 74 and 76, respectively. The belts 22 and 24 are driven by the pulleys 70 and 72, and drive a pair of pulleys 78 and 80, respectively. A pair of shafts 82 and 84, forming part of the respective shaft assemblies 26 and 28, are driven by the pulleys 78 and 80. The shaft 82 is coupled to an input shaft 86 of the motion translator 16 by a central shaft 88 and a pair of flexible couplings 90 and 92. Similarly, the shaft 84 is coupled to an imput shaft 94 of the motion translator 18 by a central shaft 96 and a pair of flexible couplings 98 and 100.

Figure 6:
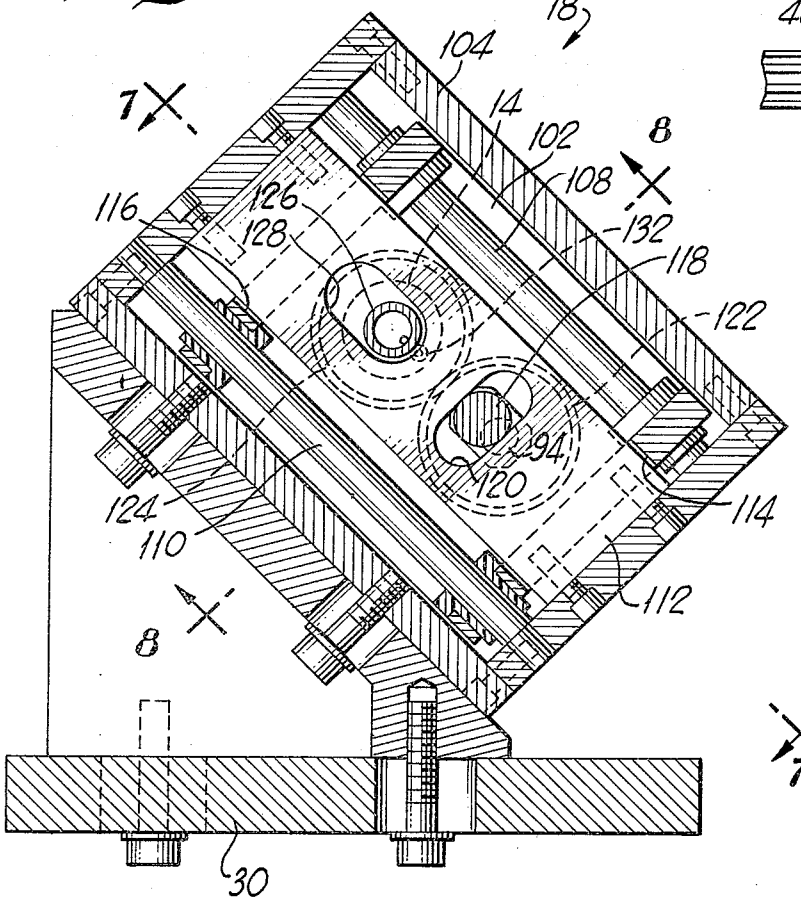
FIG. 6 is a detailed cross sectional view of the rotary to elliptical motion translator used to generate the elliptical head motion taken along line 6—6 of FIG. 3.

The rotary motion applied to the shafts 86 and 94 is converted to elliptical motion at the outputs of the respective winding heads 12 and 14 by the motion translators 16 and 18. The motion translators 16 and 18 are identical in this embodiment, and the translator 18 is shown in greater detail in FIGS. 6–8.

In accordance with an important aspect of the invention, the shaft 94 is rotatably mounted within a movable housing 102 that is slidingly mounted within a fixed housing 104. The movable housing 102 is slidingly supported within the fixed housing 104 by three rods 106, 108 and 110 that are affixed to the walls of the fixed housing 104. A plate 112 is mounted between two opposing walls of the fixed housing 104 and passes through a pair of apertures 114 and 116 formed in the opposing walls of the movable housing 102. An offset or crank 118 formed in the shaft 94 passes through an elongated aperture 120 in the plate 112. The elongated aperture 120 has its direction of elongation perpendicular to the direction of elongation of the rods 106, 108 and 110, and is dimensioned so that no force is exerted on the plate 112 in a direction perpendicular to the rods 106, 108 and 110. The shorter dimension of the aperture 120 is only slightly larger than the diameter of the crank 118, and as a result, a component of force is exerted on the plate 112 by the rotating crank 118 in a direction parallel to the rods 106, 108 and 110.

If the plate 112 were not rigidly mounted to the fixed housing 104, but were free to move, the plate 112 would be reciprocated by the crank 118 in a direction parallel to the rods 106, 108 and 110; however, since the plate 112 is rigidly fixed and cannot move, the reaction between the crank 118 and the plate 112 causes the entire housing 102 and its contents to slide along the rods 106, 108 and 110 in a reciprocating motion within the fixed housing 104. This reciprocating motion causes the winding head 14 to be reciprocated as it is rotated, thereby resulting in an elliptical motion at the output of the head 14.

In the present embodiment, rotary motion is imparted to the winding head 14 by a pair of gears 122 and 124, the gear 122 being affixed to the drive shaft 94 and the gear 124 being affixed to a support tube 126. The support tube 126 is rotatably mounted within the movable housing 102 and provides support for the winding head 14. An elongated aperture 128 is provided within the plate 112 to provide clearance for the support tube 126 when the movable housing 102 is reciprocated. The flexible couplings 98 and 100 allow the shaft assembly 28 to flex as the movable housing 102 is reciprocated.

As a result of the simultaneous rotation and reciprocation of the winding heads 12 and 14, a pair of feed tubes 130 and 132 attached to the heads 12 and 14 move in an elliptical orbit (FIGS. 9 and 10) about the coils being wound. This occurs because the housing 102 reciprocates in synchronism with the rotation of the winding head 14 so that when the housing 102 is positioned at one extreme of its travel, the feed tube 132 is displaced toward that side (FIGS. 7 and 9), and when the winding head 14 is rotated by 180°, the housing 102 reaches the other extreme of its travel (as shown in phanthom lines in FIG. 7).

Figure 9:
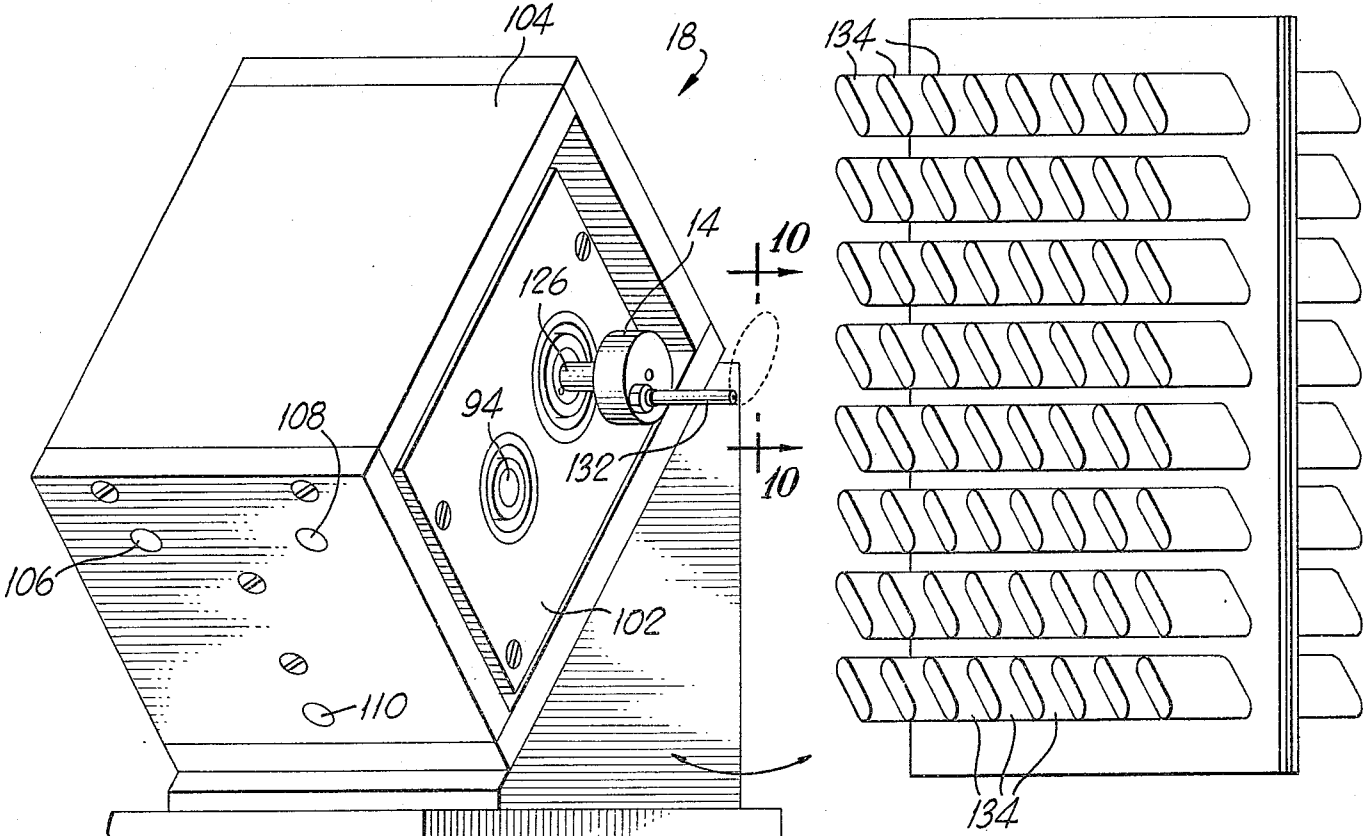
FIG. 9 is a perspective view of one of the elliptically moving winding heads and a coil array indicating the relative position of the winding head and the coil array during the winding operation.

The embodiment of the present invention illustrated in the figures was designed to wind coils around non-circular coil forms 134 having an axis of elongation disposed at a 45° angle with respect to the horizontal and vertical planes. Consequently, the motion translators 16 and 18 have been disposed at 45° angles so that the winding heads 12 and 14 are reciprocated along a line that is inclined at a 45° angle with respect to the horizontal and vertical axes, and so that the resulting ellipse has its elongated axis parallel to the direction of elongation of the coil form 134 being wound (FIG. 9).

Figure 10:
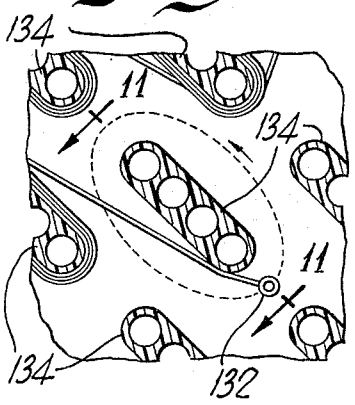
FIG. 10 is a detailed cross sectional view of one of the coils in the array showing the path of the winding head about the coil.
Figure 11:
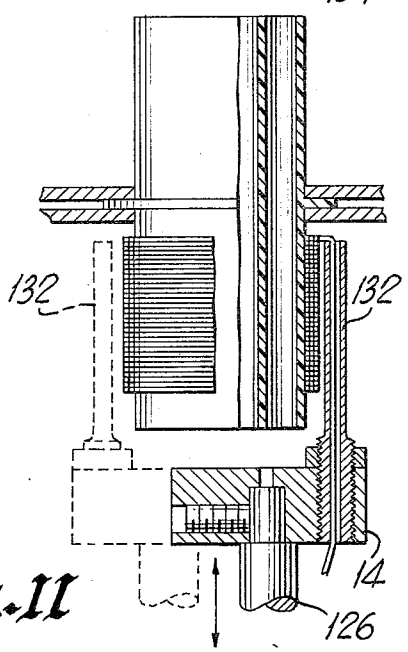
FIG. 11 is a detailed cross sectional view taken along line 11—11 of the coil shown in FIG. 10 illustrating the manner in which the coil is wound by the winding head.

After each coil is wound, it is necessary to stop the winding heads 12 and 14 in a position such that the tube 132 is positioned to clear the adjacent coil form 134 (FIG. 10) as the head assembly is stepped to the next coil. Accordingly, a position sensing device 140 (FIGS. 1, 2 and 5) is utilized to sense the position of the winding heads 12 and 14 to permit the heads 12 and 14 to be stopped in a position that permits the tubes 130 and 132 to pass between adjacent coil forms 134 (FIG. 10).

The position sensor 140 comprises eight reed switches 141–148 FIGS. 1, 2, and 5 extending radially about the shaft 60 and spaced at an angle of 45° from each other. A rotating arm member 150 having a permanent magnet 152 attached thereto is affixed to the shaft 60 and rotates in synchronism with the winding heads 12 and 14. The reed switches 141–148 have contacts that are normally open, and as the arm 150 rotates, the contacts of each of the switches 141–148 are closed sequentially as the magnet 152 is brought into proximity with each of the respective switches. Consequently, the contacts of each of the switches 141–148 are momentarily closed once every revolution, and an indication of the position of the arm 150 and the winding heads 12 and 14 is provided at 45° intervals. By connecting an appropriate one of the reed switches 141–148 to electronic control circuitry (described in a subsequent portion of the specification), the winding heads 12 and 14 can be stopped at any one of the discrete 45° intervals defined by the reed switches 141–148.

When a relatively long coil having a large number of turns is to be wound, it is necessary to move the winding heads 12 and 14 axially with respect to the coil form so that an even layer of wire may be wound about each coil form 134. This is accomplished by moving the plate 30 in a direction parallel to the direction of elongation of the rods 34 and 36 by an actuator (not shown) in order to move the winding heads 12 and 14 axially as the winding process proceeds. The actuator for moving the plate 30 may include any electrical, pneumatic or hydraulic servo mechanism, and may be controlled by the electronic control circuitry used to rotate and position the winding heads 12 and 14.

As the plate 30 is moved laterally by the servo actuator, the rods 34 and 36 are slidingly moved through the apertures in the block 38. Since the shaft 48 is rigidly affixed to the flexible coupling 52, it must be allowed to move slidingly through the sleeve 56 within the bearings 44 and 46. This is accomplished by providing splines 154 in the interior of the sleeve 56 and a mating set of splines 156 around the periphery of the shaft 48. The relative sizes of the splines 154 and 156 are selected to permit axial movement between the sleeve 56 and the shaft 48 while permitting rotary motion imparted from the sleeve 56 to the shaft 48 to drive the winding assembly 10.

In addition to the axial movement of the winding heads 12 and 14, apparatus must be provided to step the winding heads 12 and 14 between adjacent coils. This may be accomplished by moving either the head assembly 10 or the array of forms 134. In the preferred embodiment, the array of forms 134 is moved, because of its lower mass, by stepping actuators (not shown) controlled by the control electronics of the winding machine. Such actuators are well known, and therefore, will not be discussed in detail.

Figure 12:
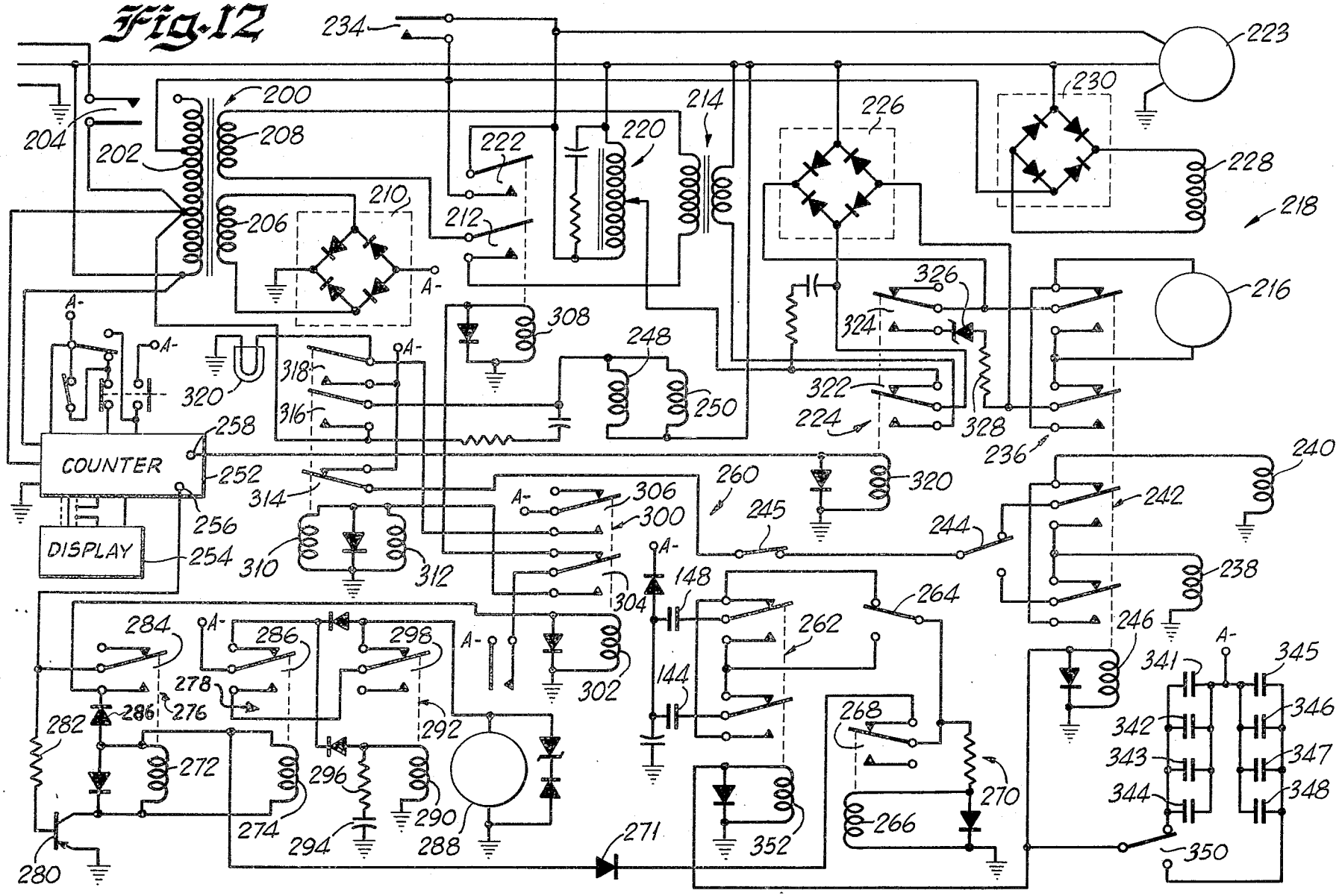
FIG. 12 is an electrical schematic of the control circuit used in conjunction with the winding machine according to the present invention.

The electrical control and drive circuitry for the winding head assembly 10 is illustrated in FIG. 12. The circuitry illustrated in FIG. 12 incorporates much of the circuitry of the Meteor MF307-01 winding machine previously discussed, and which is included only as background information to illustrate the operation of the winding machine according to the invention. Accordingly, the components contained in the standard Meteor winding machine will be described only briefly to illustrate their function, and the circuitry added to the standard winding machine will be discussed in greater detail. Standard transient arc and suppression circuitry, and the like, will not be discussed.

The basic winding machine contains a power transformer 200 that has a multiply tapped primary winding 202 that is connected to the power mains through switch 204, and a pair of secondary windings 206 and 208. The secondary winding 206 is connected to a rectifier bridge 210 that provides a DC voltage for energizing the various relays in the circuit, and the secondary winding 208 is coupled through a set of relay contacts 212 to a transformer 214 that is used to energize an armature 216 of the drive motor 218 when the motor is operated in its slow mode of operation. A speed control 220 is coupled to the power line and to a tap on the primary 202 of the transformer 200 via a set of contacts 222. The speed control 220 is used to energize the motor 216 during high speed operation. A set of contacts 224 couples either the transformer 214 or the speed control 220 to a rectifier bridge 226 depending on whether the fast or slow mode of operation is desired. Direct current for a field winding 228 of the motor 218 is provided by a bridge rectifier 230 also connected to a tap on the primary winding 202 of the transformer 200. An electromechanical brake 223, controlled by a set of contacts 234, may be used to bring the motor 218 to a fast stop.

A polarity reversing switch 236 is interposed between the bridge rectifier 226 and the motor armature 216 so that the motor armature may be operated in either direction for winding coils in opposite directions. A pair of left and right traverse solenoids 238 and 240 are employed to move the winding heads 12 and 14 axially (either directly or via a power amplifying servo mechanism) to wind the coils uniformly about the coil forms 134. The left and right traverse solenoids 238 and 240 are energized by the bridge circuit 210 which is coupled to the solenoids by a second polarity reversing switch 242 (via a selector switch 244, an interrupt switch 245 and contacts 314) to permit either of the solenoids 238 and 240 to be energized with either polarity voltage depending on the direction of winding and the desired pitch of the coil. Both of the polarity reversing switches 236 and 242 are controlled by a common relay coil 246. A wire tension solenoid 248 and a traverse return solenoid 250 are employed to provide the proper wire tension and to return the winding heads 12 and 14 to their initial positions upon the completion of each coil winding operation.

A counter 252 counts the number of revolutions of the winding heads 12 and 14 and drives a display unit 254 to indicate the total number of revolutions. The counter 252 is a presettable counter that provides a stop signal at an output 256 when the preset count has been reached. In addition, the counter 252 provides a slow down signal at an output 258 after a second preset count has been reached. This permits the motor 218 to be slowed before it is stopped to permit the positioning circuitry to position the heads 12 and 14 to pass between adjacent coils.

In accordance with an important feature of the invention, a positioning circuit 260 is utilized to sense the position of the winding heads 12 and 14 to permit the winding heads 12 and 14 to be properly positioned to pass between adjacent coil forms as the heads 12 and 14 are stepped between coils. Two of the reed swtiches 141–148, in this embodiment switches 144 and 148, are connected to the circuit 260 to permit the winding heads 12 and 14 to be stopped in a position corresponding to the coincidence of the arm 150 and one of the switches 144 and 148. In either of these positions, the winding heads 12 and 14 will pass between adjacent rows of coil forms 134 of the array (illustrated in FIGS. 9 and 10). The other ones of the switches 141–148 may be connected to the circuit 260 when differently configured arrays requiring a different clearance positioning of the heads 12 and 14 are being wound.

Switches 262 and 264 are employed to determine which one of the reed switches 144 and 148 will determine the stopping positions of the heads 12 and 14. In the present embodiment, the selection of the reed switches 144 and 148 is determined by the winding direction of the coil being wound. Therefore, the switch 262 is activated simultaneously with the motor reversing switch 236 so that the appropriate one of the switches 144 and 148 is automatically selected. The switch 264 selects which of the contacts 144 and 148 is to correspond to each winding direction to provide greater flexibility in programming.

Suppose, as is shown in FIG. 12, the reed switch 148 has been selected, then each time the arm 150 passes the reed switch 148, a −24 volt signal from the bridge circuit 210 is applied to the coil 266 and contacts 268 of a relay 270. The relay 270 is a slow to operate relay and hence, the signal from the reed switch 148 is applied to the coils 272 and 274 of a pair of relays 276 and 278, respectively, before the relay 270 is pulled in.

Each of the pulses from the reed switch 148 attempts to energize the two coils 272 and 274 in an attempt to operate the relays 276 and 278, however, the relays 276 and 278 will not operate unless a transistor 280 is rendered conductive by the output 256 of the counter 252. As a result, nothing happens until the counter 252 reaches its preset final count.

When the counter reaches the preset final count, a negative potential is applied from the output 256 to the base of the transistor 280 through a resistor 282. The negative potential renders the transistor 280 conductive to complete the circuit between the relay coils 272 and 274 and ground so that the next pulse received from the reed switch 148 operates the relays 276 and 278.

When the relay 278 operates, a set of contacts 284 is closed, thereby applying the negative signal from the output 256 of the counter 252 to the coils 272 and 274 through the contacts 284 and a diode 286 to maintain the coils 272 and 274 energized. Simultaneously, the operation of the relay 276 operates a set of contacts 286, thereby deenergizing a clutch 288 and a coil 290 of a relay 292. The coil 290 of the relay 292 remains energized for a short period of time determined by the time constant of a capacitor 294 and a resistor 296, and maintains the clutch 288 deenergized during that time. This decouples the drive train from the winding heads 12 and 14 to reduce the mass of the rotating system and to allow the heads 12 and 14 to be brought to a stop more quickly. After the discharge of the capacitor 294, the clutch 288 is again energized through the normally closed contacts 298 of the relay 292 and the normally open contacts 296 of the relay 278; however, in the interim, the motor 218 has been deenergized, and has been braked to a stop by the brake 223 so no further rotary motion is imparted to the heads 12 and 14.

The motor 218 is deenergized by a relay 300 having a coil 302 that is energized from the output 256 of the counter 252 when the relay 278 is energized. The relay 300 has two sets of contacts 304 and 306. The energization of the coil 302 operates the contact set 304 to deenergize a coil 308 and to energize a relay coil 310 and a wire reel brake coil 312. The deenergizing of the relay coil 308 opens the contacts 212 and 222 and removes power from the speed control 220, the transformer 214 and the brake 223. This deenergizes the armature 216 of the motor 218, and consequently deenergizes the motor 218, while braking the motor 218 to a stop. The energizing of the wire reel brake 312 brakes the wire reel to prevent the spillage of wire, and the energization of the relay coil 310 opens a contact set 314 and closes a pair of contact sets 316 and 318. The opening of the contact set 314 deenergizes the left and right traverse solenoids 238 and 240. The closing of the contact set 316 energizes the wire tension solenoid 248 and the traverse return solenoid 250 to bring the winding heads 12 and 14 into position to begin the winding of a new coil, and the closing of the contact set 318 lights an indicator lamp 320.

In order to provide for a more accurate positioning of the winding heads 12 and 14, the clutch 288 is employed to disconnect the winding heads 12 and 14 from the rotating mass of the motor 216 momentarily so that the heads 12 and 14 would not be carried past the intended stopping point by the rotating mass of the motor armature 216. However, even when a clutch such as the clutch 288 is utilized to disengage the motor 218 from the heads 12 and 14, it is desirable to slow the motor 218 down before initiating the stopping and positioning operation. This slow down provides an even more accurate control of the final position of the heads 12 and 14.

The slow down operation is triggered by the "slow down" output 258 of the counter 252 and the relay 224. The counter 252 is programmed to generate a slow down signal at the slow down output 258 a preselected number of turns before the stop signal is generated at the output 256. When the slow down signal is generated, a coil 320 of the relay 224 is energized, thereby activating a contact set 322 to cause the rectifier 226 to be connected to the output of the transformer 214 rather than to the speed control unit 220. The output voltage of the transformer 214 is typically lower than the output voltage of the speed control unit 220, thereby resulting in a reduced voltage being applied to the armature 216 of the motor 218. A second contact set 324 is also operated by the energization of the coil 320 and causes the series combination of a Zener diode 326 and a resistor 328 to be placed across the terminals of the armature 216. The series combination of the Zener diode 326 and the resistor 328 serves as a load across the terminals of the armature 216 and serves as a dynamic braking load to slow down the armature 216 more quickly after the transformer 214 has been deenergized by the opening of the contacts 212.

The winding machine according to the invention may be programmed in a variety of ways. For example, the winding machine may be programmed to wind all of the coils in an array in the same direction or to wind preselected ones of the coils in opposite directions. For example, the coil winding machine of the illustrated embodiment has been programmed to wind an 8 × 8 array of coils with alternate ones of the coils being wound in opposite directions.

In the present embodiment, the alternation of the winding direction is determined by a set of reed switches 341–348 that are selectively closed in response to the relative position of the winding heads 12 and 14 and the coil array being wound. The reed switches 341–348 are similar to the position sensing reed switches 141–148 and are actuated by a moving magnet that moves relative to the position of the reed switches 341–348 as the winding machine advances between coils in the array.

In the embodiment shown, the reed switches 341–344 are utilized when the coils are being wound in a horizontal sequence (X coordinate switches) while the switches 345–348 are utilized when the array is being wound in a vertical sequence (Y coordinate switches). A selector switch 350 selects the switches 341–344 when a horizontally stepped array is being wound and the switches 345–348 when a vertically stepped array is being wound.

If a horizontally stepped array is being wound, the switch 350 is positioned as shown in FIG. 12 to thereby connect the switches 341–344 to the coil 246 of the relay 242 and to the coil 352 that actuates the contacts 262. The relative position of the reed switches 341–344 and the actuating magnet is selected, in this embodiment, so that all of the switches 341–344 are open when the odd numbered coils (1, 3, 5 and 7) of the array are being wound, and one of the switches 341–344 is closed when the even numbered coils (2, 4, 6 and 8) are being wound. Consequently, when the odd numbered coils are being wound, the coils 246 and 352 are deenergized. This causes the armature 216 of the motor 218 to rotate in a first direction, and causes the reed switch 148 to control the stopping position of the heads 12 and 14. When the odd numbered coils are being wound, both of the coils 246 and 352 are energized, thereby reversing the direction of rotation of the armature 216 and selecting the opposite one of the traverse solenoids 238 and 240. In addition, the reed switch 144 is selected to control the stopping point of the heads 12 and 14 so that the heads 12 and 14 may be stopped in a different position to permit clearance between the winding heads and the coils when the opposite direction winding is being employed.

In a similar fashion, when the array is being wound in the vertical direction, the selector switch 350 is switched to select the Y coordinate reed switches 345–348 to permit alternate direction winding of adjacent coils in the vertical direction. The direction of winding may be easily modified by simply changing the relative position of the magnet and the reed switches 341–348 or by disconnecting predetermined ones of the switches 341–348 so that any sequence of alternation of winding may be achieved.

While certain preferred embodiments of the invention have been described by way of illustration, many modifications will occur to those skilled in the art; it will be understood, of course, that it is not desired that the invention be limited thereto, since modifications may be made, and it is, therefore, contemplated by the appended claims to cover any such modifications as fall within the true scope and spirit of the invention.

What is claimed as new and desired to be secured by Letters Patent of the United States is:

1. Apparatus for winding a length of elongated material onto a material receiving element comprising means including a feed member for paying out said elongated material, means coupled to said feed member for rotating said feed member in a circular orbit about a predetermined axis and means for simultaneously reciprocating said feed member along a path perpendicular to said predetermined axis for superimposing a reciprocating motion onto said circular orbit for orbiting said feed member about said material receiving element in a noncircular orbit thereby to wind said elongated material onto said material receiving element.

2. Apparatus as recited in claim 1 wherein said rotating and reciprocating means include a source of rotary motion, a shaft having an eccentric section, said shaft being coupled to said rotary motion source and to said feed member and transferring rotary motion from said rotary motion source to said feed member, and stationary means engaging said eccentric section for imparting a lateral reciprocating movement to said shaft in response to rotation of said shaft.

3. Apparatus as recited in claim 2 wherein said eccentric section includes a crank.

4. Apparatus as recited in claim 2 wherein said stationary means includes a plate having an elongated aperture defined therein for receiving said eccentric section.

5. Apparatus as recited in claim 2 wherein said rotating and reciprocating means includes a base and a support member for said feed member, said support member being slidably mounted to said base to permit relative lateral motion between said support member and said base in response to the rotation of said eccentric section.

6. Apparatus as recited in claim 5 wherein said shaft includes a flexible coupling.

7. Apparatus as recited in claim 1 further including means for providing an indication representative of the position of said feed member coupled to said rotating and reciprocating means for terminating the operation of said rotating and reciprocating means only when said feed member is positioned in a predetermined position.

8. Apparatus as recited in claim 7 wherein said indication providing means includes means for altering said predetermined position.

9. Apparatus as recited in claim 7 further including means coupled to said rotating and reciprocating means for selectively reversing the direction of rotation of said feed member.

10. Apparatus as recited in claim 9 further including means interconnecting said reversing means and said position altering means for altering said predetermined position in response to the direction of rotation of said feed member.

11. Apparatus as recited in claim 9 wherein said position indicating means includes a plurality of magnetically actuated switches and a magnetic actuator mounted for rotation in synchronism with said feed members.

12. Apparatus as recited in claim 1 wherein said reciprocating means includes means for reciprocating said feed member along a linear path of travel.

13. A method for winding coils having a noncircular cross section comprising the steps of providing a wire feed member, circularly orbiting the wire feed member, simultaneously moving the orbiting wire feed member in a reciprocating motion to thereby superimpose a predeterminedly related reciprocating motion onto a circularly orbiting wire feed member to modify the orbit of the wire feed member into a noncircular orbit.

14. The method recited in claim 13 wherein the step of circularly orbiting the wire feed member includes the step of orbiting the wire feed member around a predetermined orbital axis and the step of simultaneously moving the wire feed member in a reciprocating motion includes the step of reciprocating the orbital axis in a direction perpendicular thereto.

15. The method recited in claim 13 further including the steps of terminating the movement of the wire feed member in a predetermined position, moving the wire feed member to a second location, and winding a second coil at the second location by moving the wire feed member in a noncircular orbit about the second coil.

16. The method recited in claim 15 wherein the second coil is wound in a direction opposite to that of the first coil.

17. The method recited in claim 14 wherein the step of reciprocating the orbital axis includes the step of reciprocating the orbital axis along a linear path of travel.

18. Apparatus for winding a length of elongated material onto a material receiving element comprising:

a winding head having a feed tube extending therefrom, said feed tube having a passageway defined therein for passing said elongated material therethrough onto said material receiving element;

means coupled to said winding head for rotating said winding head about a predetermined axis thereof to thereby cause the feed tube to revolve about said predetermined axis in a circular orbit; and means coupled to said winding head for reciprocating said winding head along a linear path of travel perpendicular to said predetermined axis of rotation to thereby superimpose a linear reciprocating motion onto the rotation of said winding head and cause said feed tube to revolve in a noncircular orbit.

* * * * *